United States Patent [19]

Storck

[11] 4,256,359

[45] Mar. 17, 1981

[54] TERMINATION CONNECTOR

[75] Inventor: Glenn E. Storck, Long Valley, N.J.

[73] Assignee: Thomas & Betts Corporation, Raritan, N.J.

[21] Appl. No.: 42,356

[22] Filed: May 25, 1979

[51] Int. Cl.[3] ..... H01R 11/20; H01R 4/10

[52] U.S. Cl. ..... 339/97 C; 174/78; 339/276 R

[58] Field of Search ..... 339/97, 95, 98, 99, 339/276 R, 276 F, 276 T, 277, 17 F, 17 LC, 266, 269, 271, 276 S; 174/78

[56] References Cited

U.S. PATENT DOCUMENTS

| | | | |
|---|---|---|---|
| 3,728,473 | 4/1973 | Kuo | 339/97 C X |
| 3,752,901 | 8/1973 | Kuo | 339/95 R X |
| 3,753,213 | 8/1973 | Frey | 339/97 R |
| 3,777,049 | 12/1973 | Gillemot | 339/97 R X |
| 3,812,381 | 5/1974 | Guyton | 339/17 LC X |
| 3,851,945 | 12/1974 | Collier | 339/176 MF X |
| 3,857,994 | 12/1974 | Neale, Sr. | 339/97 R X |
| 3,937,403 | 2/1976 | Lawson | 339/97 C |
| 3,960,430 | 6/1976 | Bunnell et al. | 339/97 C |
| 3,984,621 | 10/1976 | Propst | 174/48 |
| 4,002,393 | 1/1977 | Merry et al. | 339/97 C |
| 4,030,801 | 6/1977 | Bunnell | 339/121 |
| 4,054,353 | 10/1977 | Saunders et al. | 339/176 MF |

FOREIGN PATENT DOCUMENTS

| | | | |
|---|---|---|---|
| 131406 | 4/1951 | Sweden | 339/276 S |

OTHER PUBLICATIONS

Publication-"Under Carpet Power & Communication Wire System", Fleischhacker, Nov. 1975, pp. 18-20.

Publication-"Flat Cable: Under-Carpet Breakthrough," *Building Design & Construction, Apr. 1979, pp. 26-29.*

Publication, "The Great Cover Up" undated.

Publication, "A Better Way to Wire," *Telephony 1--8-79.*

Publication: "Flat Conductor Cable Bldg. Wiring Systems," NASA, undated.

Publication: "Tentative Int. Amend. to the 1978 Nat. Elect. Code," NFPA, Jan. 1978.

MSFC-SPEC-494A, 4-30-73.

NASA-TM-X64916, Mar. 1975.

NASA-TM-X64887, Aug. 1974.

NASA SP 5120, Dec. 74, pp. 28-29. $U_3$ Pub. "TUCC Sys." undated.

*Primary Examiner*—John McQuade

*Assistant Examiner*—John S. Brown

*Attorney, Agent, or Firm*—James J. Daley; Robert M. Rodrick; Jesse Woldman

[57] ABSTRACT

A terminal connector for flat cables. The connector comprises a bendable member for bending along a bending line which divides the bendable member into first and second arm portions separated from one another by the bending line. The first arm portion includes a male die member thereon extending away from the surface thereof, and the second arm portion includes a die opening for receiving the male die member when the bendable member is bent along the bending line to move the first and second arm portions toward one another into a closed connecting position.

40 Claims, 22 Drawing Figures

TERMINATION CONNECTOR

BACKGROUND OF THE INVENTION

The present invention relates to electrical connectors, and more particularly to electrical connectors for terminating flat conductor cables.

Flat conductor cable was developed as an alternative to present electrical installation practice utilizing troughs/conduit placed below floor level. The flat cables are intended to be placed flush to the floor surface with the necessary branch circuits leading to the desired locations with carpeting then placed over the cable to provide a surface suitable for interior use and for personnel traffic. With such a system, it is necessary to provide electrical receptacles in the housing for termination at each of the desired locations. Coupled with this requirement is the requirement for suitable electrical/mechanical termination of the flat conductor cable, which is generally of a thin rectangular cross-section.

Prior art techniques for terminating flat cable conductors, especially those for use with telecommunications equipment, have included complicated, specialized termination connectors for a plurality of conductors of flat cable which are then adapted to mate with other suitably designed connectors which are connected, for example, to a plurality of round wire conductors to provide for transition from the flat cable conductors to the rounded wire conductors. For example, such an arrangement may be seen in U.S. Pat. No. 3,760,335 which shows a housing for receiving the flat cable in one side and which are adapted to mate with a complimentary connector on the other side.

Another prior art technique for terminating flat conductor cables has included insulation piercing techniques for providing a rounded opening for mounting purposes. An example of such a prior art technique is shown in U.S. Pat. No. 3,549,786. In one embodiment of this patent, rounded openings for mounting are provided in both the upper and lower surfaces of the connector which are intended to accept a mechanical type fastener (such as for example a screw) utilized for mounting of the assembled connector to an appropriate termination device or mounting surface. After mounting of the connector on the flat cable conductor, a corresponding opening must be cut, punched, or drilled through the conductor to accept the mechanical fastening means. It should be noted that after insulation, both the upper and lower halves of the connector must be in proper alignment to provide an opening which is interference free to allow for the mechanical fastener to have free access through the connector for attachment to an appropriate termination device.

As can be appreciated, this procedure requires additional installation techniques with associated added tooling expenditures as a result thereof. Further, it should be appreciated that difficulties may also be experienced in maintaining proper alignment of the upper and lower connector halves during assembly of the connector onto the flat conductor. Further still, high concentration forces directly under the mechanical fastener may be transferred to the connector faces during the tightening process which, because of a lack of support directly under the fastener, may cause bending or dishing of the connector surface during tighening. That is, the contact surface acts as a simply supported beam having the ends or outer edges supported by the insulation piercing mechanism with the mechanical fasteners then exerting a concentrated load causing bending or lowering of the contact surface at the center. This action may tend to relieve pressure in the insulation piercing mechanism thereby reducing the electrical contact effectiveness.

SUMMARY OF THE INVENTION

There is provided in accordance with the present invention a terminal connector which is particularly useful for making electrical contact with the conductor of flat cables. The terminal connector comprises a bendable member which is bendable along a bending line and which includes a first arm portion and a second arm portion separated from one another by the bending line. The first arm portion includes a male die member thereon extending away from the surface of the first arm portion and the second arm portion includes a die opening for receiving the male die member when the bendable member is bent along the bending line to move the first and second arm portion towards one another into a closed connecting position.

In a preferred embodiment, the male die member is electrically conducting so that placement of a flat cable between the first and second arm portions and bending of the bendable member along the bending line causes the male die member to pierce and make electrical contact with the conductor of the flat cable. It should be noted that electrical connection is assured by virtue of the male die member entering the die opening to secure the flat cable in place between the first and second arm portions.

Preferably, the male die member includes cutting means at the end thereof for piercing the flat cable as the male die member enters the die opening. Still further, the male die member preferably extends away from the first arm portion at an angle such that the second arm portion is inclined with respect to the cutting means when the male die member begins to enter the die opening as the bendable member is bent along the bending line so that only a portion of the cutting means engages the flat cable initially to thereby concentrate the cutting force exerted on the flat cable. In this way, only a portion of the cutting means enters the die opening initially and the remaining portions of the cutting means progressively enters the die opening as the first and second arm portions are moved towards one another to complete the cutting of the opening in the flat cable. This allows for less force being required to move the conductor member into its closed position to make electrical contact with the conductor of the flat cable while ensuring that the connector is retained on the flat cable.

In another preferred embodiment, the male die member includes an opening therethrough which is adapted to receive a mechanical fastener for connecting the terminal connector affixed to the flat cable to a suitable device or mounting surface. The end of the male die member preferably extends at least to the outside surface of the second arm portion so that it provides a support for the transfer of the mechanical load through the connector to a mounting surface so that the load caused by the mechanical fastener is not applied directly to the flat surfaces which might otherwise have a tendency to relax the electrical contact pressure and ensure a good transfer of current from the cable to the connector.

Further in accordance with the present invention, various cutting surfaces are disclosed for the end of the upstanding male die member, as well as means for holding the first and second arm portions in a closed position. Further still, means are disclosed for facilitating bending of the connector member along the bending line.

These and further features and characteristics of the present invention will be apparent from the following detailed description in which reference is made to the enclosed drawings which illustrate the preferred embodiments of the present invention.

BRIEF DESCRIPTION OF THE DRAWINGS

FIGS. 6*c* and 6*d* are perspective views of portions of the first arm portion and male die member of alternative embodiments of the connector for facilitating holding of the first and second arm portions together.

DETAILED DESCRIPTION OF THE PREFERRED EMBODIMENT

Figure 1:
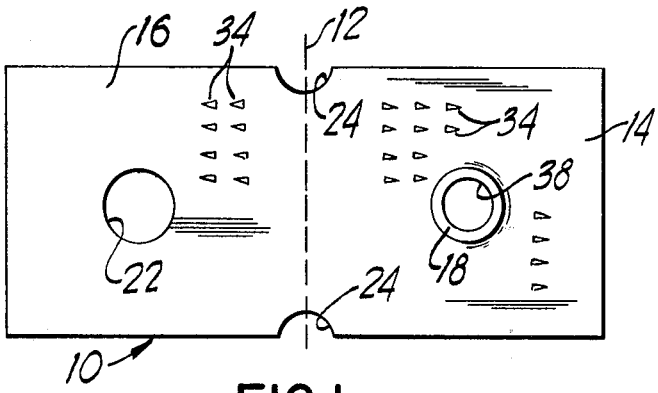
FIG. 1 is a plan view of the flat layout of the connector in accordance with the present invention, showing the major components thereof.
Figure 2:
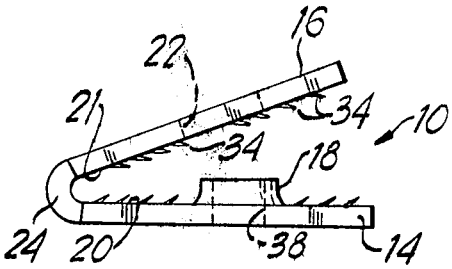
FIG. 2 is a side view of the connector in accordance with the present invention prior to installation on a flat cable, showing the first and second arm portions thereof bent along the bending line and arranged in a position to receive a flat cable.

Referring now to the drawings in which like reference characters represent like elements, there is shown in FIGS. 1 and 2 a terminal connector 10 particularly useful for flat conductor cables in accordance with the present invention. FIG. 1 shows a flat layout of the connector to illustrate the major components thereof. The connector 10 includes a bendable member adapted to bend along a bending line 12 to define first and second arm portions 14, 16. Preferably, the entire member 10 is metallic so as to be suitable for conducting electricity when the connector 10 is attached to and makes electrical contact with the conductor of the flat conductor cable. The first arm portion 14 of the connector 10 is provided with a male die member 18 extending away from the surface 20 of the first arm portion 14, and the second arm portion 16 includes a die opening 22 extending therethrough.

The male die member in the embodiment shown in FIGS. 1 and 2 comprises an upstanding post extending away from the surface 20 of the first arm portion 14 and arranged with respect to the die opening 22 of the second arm portion 16 so as to enter the die opening 22 when the second arm portion 16 is folded about the bending line 12 toward the post 18 and the first arm portion 14 to overlie same. To provide for proper alignment of the upstanding post 18 and die opening 22 in the first and second arm portions 14, 16 respectively, the upstanding post 18 and die opening 22 are properly positioned at equal distances from the bending line 12 so that the post 18 will be received within the opening 22 when the bendable connector member 10 is bent along the bending line 12. To facilitate precision bending of the first and second arm portions 14, 16 about the bending line 12, cutouts 24 are provided to reduce the cross-sectional area along this line 12. In effect, these cutouts 24 reduce bending forces with respect to cross-sectional area and ensure that the complete bend will take place at the desired location.

FIG. 2 shows the arrangement of the connector 10 prior to installation onto the flat cable. As best seen in FIG. 2, the upstanding post 18 extends substantially normal to the surface 20 of the first arm portion 14 so that the upper end surface 26 of the post 18 is initially inclined with respect to the second arm portion 16 having the die opening 22 therein.

Figure 3A:
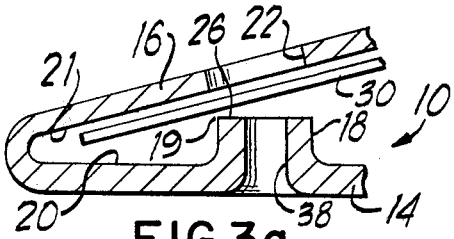
FIGS. 3*a*, 3*b*, and 3*c* are side sectional views of the connector in accordance with the present invention showing how the connector is installed on a flat cable and indicating the mechanism for removing a section of the conductor to allow for use of a mechanical fastener.
Figure 3B:
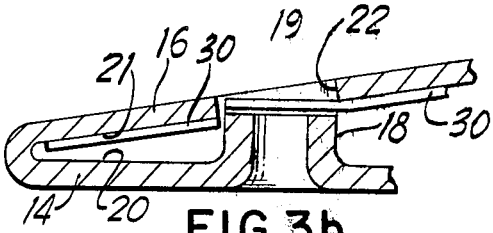
Figure 3C:
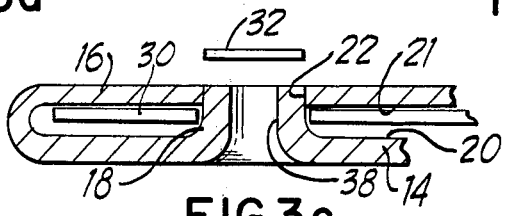

FIGS. 3*a*–3*c* illustrate the sequence of steps for assembling the terminal connector 10 onto flat conductor cable 30 to make electrical contact therewith. At the beginning of the installation (see FIG. 3*a*), flat conductor cable 30 is inserted between the first and second arm portions 14, 16 so that the upstanding post 18 is located on one side of a flat conductor cable 30 and the die opening 22 for receiving the post 18 is located on the opposite side. As the first and second arm portions 14, 16 are moved closer together (preferably with the use of a suitable tool for accomplishing the bending), the portion of the upstanding post 18 closest to the bending line 12 contacts the flat conductor cable 30 first and shears through same at that point as shown in FIG. 3*b*.

It is to be appreciated that as only a portion or small surface area of the upstanding post 18 initially contacts the flat conductor cable 30 during this installation, a "scissors" type action is obtained by virtue of the geometry of the upstanding post 18 and the matching die opening 22 which interact at an acute angle with each other. This has the tendency of reducing the force necessary to shear a portion of the conductor and installation of the cable 30 by concentrating the force over a very small area, thereby increasing the applied shearing stress on the flat conductor cable 30. Further bringing together of the first and second arm portions completes the shearing of the flat conductor cable 30 as the shear surface "moves" to complete the cutting of a blank 32 from the flat cable 30 which may then be easily removed (see FIG. 3*c*). It should be noted that the cutting action provided by the post 18 provides a smooth cut surface as opposed to a punched one which might leave a torn, ragged edge. This thus ensures for improved electrical connection between the conductor of the flat cable 30 and the terminal connector 10.

In essence, the cutting out of a hole in the flat conductor cable 30 is accomplished by only initially cutting a small area of the conductor as only a portion of the cutting edge of the upper surface 26 of the post 18 initially contacts the flat conductor cable 30 and enters the die opening 22. By forcing this small edge into the die 22 with the flat conductor cable 30 being located therebetween, a smooth cutting of the conductor cable 30 takes place, with the cutting or shearing continuing about the circumference of the opening 22 during further movement of the two arm portions 14, 16 toward one another as the circumferential edge at the upper end 26 of the post 18 progressively enters the die opening 22. It can be appreciated that a substantially lower force is required for accomplishing this cutting of a hole in the flat conductor cable 30 in this manner than if the entire end of the post 18 were inserted evenly into the die opening 22, in which case, substantially greater force would be required to effect the shearing or cutting operation of the blank 32 in the flat conductor cable 30.

It should be noted that this progressive shearing of the conductor cable 30 during connecting of the connector 10 to the flat cable 30 is accomplished by virtue of the geometry in which the cutting surface on the post 18 (i.e., the outer edge 19 on the upper end 26 of the post 18) are inclined with respect to the plane of the surface in which the die opening 22 is located. It should further be realized that such a geometry is ensured by having the second arm portion 16 bending about a bending line 12 which separates the connector 10 into the first and second arm portions 14, 16—i.e., the second arm portion 16 is bent about a line 12 lying on the surface of the connector 10 and in which the upstanding post 18 to be received within the die opening 22 extends away from the surface of the connector 10.

Electrical contact between the connector 10 and the flat conductor cable 30 is accomplished by virtue of the conductor of the cable 30 being in intimate contact with the upstanding post 18 of the connector 10. Additionally, conventional insulation piercing members or teeth 34 may be provided on the surfaces 20, 21 of the first and second arm portions 14, 16 (see FIGS. 1 and 2) which pierce the insulation and come into intimate contact with the conductor of the flat conductor cable 30 when the connector 10 is attached to the flat conductor cable 30. Such insulation piercing teeth or members 34 may be of a conventional type, such as for example those shown in U.S. Pat. No. 3,549,786.

In a preferred embodiment, the upstanding post 18 on the first arm portion 14 is hollowed out to provide for receipt of a suitable mechanical fastener 36 for attaching the terminal connector 10, and thus the flat cable 30, to a suitable termination device. FIG. 4*a* shows a completely installed terminal connector 10 on a flat conductor cable 30 and illustrates this additional feature of the upstanding post 18 which is received within the die opening 22 of the second arm portion 16. As shown in FIG. 4*a*, a mechanical fastener 36, such as for example a threaded bolt or screw, is placed through the opening 38 of the upstanding post 18 with the threaded portion extending beyond the surface of the connector 10. This threaded portion is received within an appropriate threaded opening in a suitable termination device 40 such as for example a bus bar, a junction box or other suitable surface for making electrical and/or mechanical contact with the connector 10 on the flat cable 30.

It should be noted that the upper end 26 of the post 18 extends through the die opening 22 in the second arm portion 16 to provide a means for transferring the mechanical load applied by the mechanical fastener 36 when tightened through the connector 10 to the mounting surface of the termination device 40. That is, the upstanding post 18 transmits the load caused by the tightened fastener 36 to the surface of the first arm portion 14 and not the second arm portion 16. If the post 18 were not used, tightening of the fastener 36 would move the area of the second arm portion 16 surrounding the die opening 22 directly under the fastener towards the first arm portion, thereby causing the upper arm portion to bend or "dish". Such bending or dishing might in turn have a tendency to relieve pressure on the insulation piercing mechanism, thereby reducing the electrical contact effectiveness for the connector. This relaxation of forces however will not occur with the arrangement of the present invention as the force is transmitted through the upstanding post 18 to the lower surface of the first arm portion 14 allowing upper arm portion 16 to float or seek its own centering position.

Figure 4B:
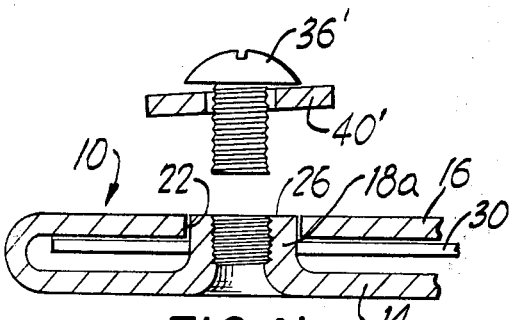
FIG. 4*b* shows an exploded view of an alternative embodiment for the connector installed on a flat cable and of a mechanical fastener therefor.
Figure 4A:
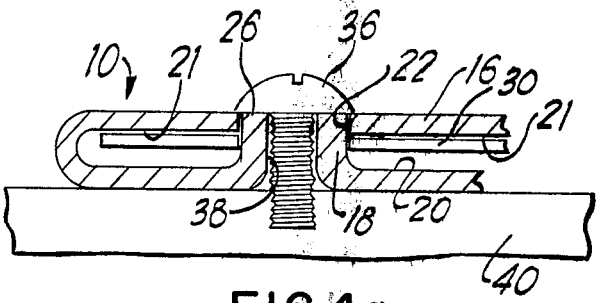
FIG. 4*a* is a side sectional view of the connector in accordance with the present invention installed on a flat connector, the connector in turn being connected by means of a mechanical fastener to a suitable mounting surface.

FIG. 4*b* illustrates another similar arrangement for attaching the connector 10 to a termination device 40'. In the embodiment of FIG. 4*b*, the inner portion of the upstanding post **18*a* is threaded to accept a machine screw 36' for attaching an electrical contact lug 40** thereto which in turn might be connected to another conductor, such as for example a round wire cable.

Figure 5:
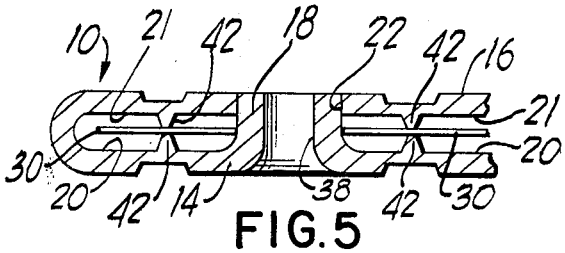
FIG. 5 shows an alternative embodiment for the connector of the present invention installed on a flat cable in which means are provided for ensuring electrical contact between the flat cable and the male die member.
Figure 6A:
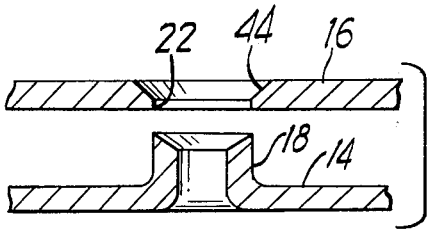
FIGS. 6*a* and 6*b* show exploded side sectional views of portions of alternative embodiments of a connector in accordance with the present invention showing variations for facilitating holding of the first and second arm portions together.
Figure 6B:
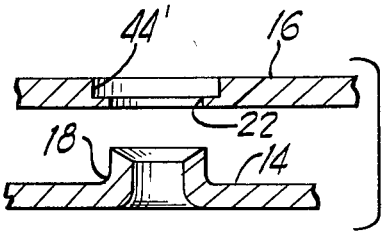
Figure 6C:
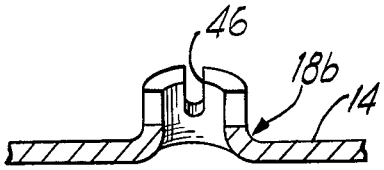
Figure 6A:
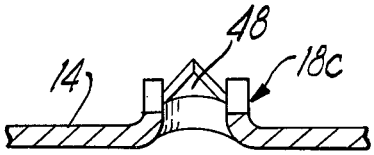
Figure 7A:
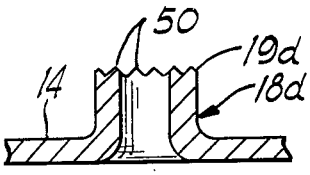
FIGS. 7*a*–7*e* are side sectional views of portions of further embodiments of the connector in accordance with the present invention showing variations of the male die member for facilitating cutting of the flat cable.
Figure 7B:
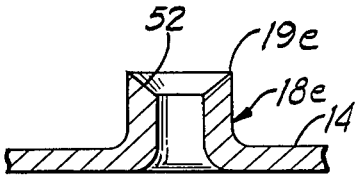
Figure 7C:
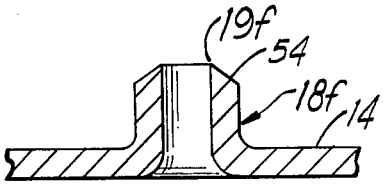
Figure 7D:
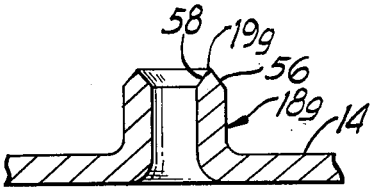
Figure 7E:
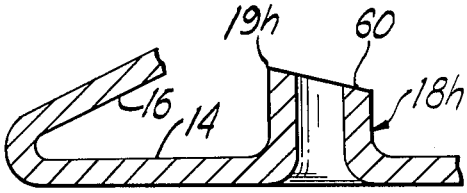
Figure 8A:
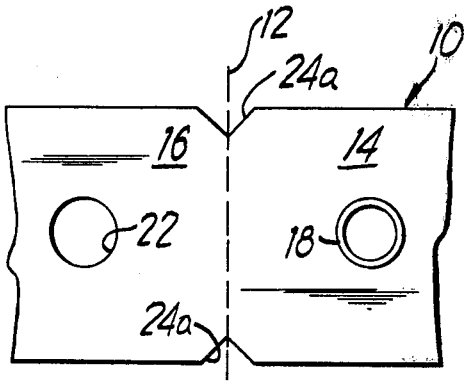
FIGS. 8*a*–8*c* show variations of cutouts along the bending line of the connector in accordance with the present invention for facilitating bending of the connector member.
Figure 8B:
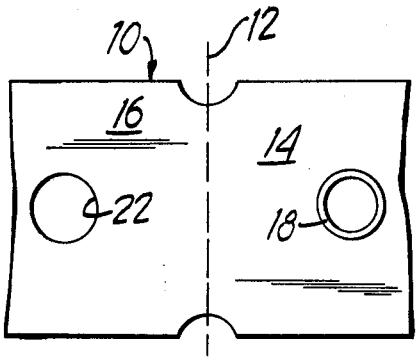
Figure 8C:
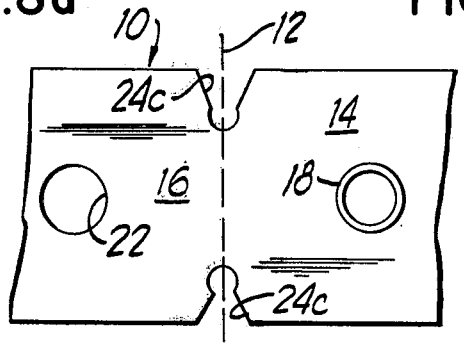

FIG. 5 shows an alternative embodiment for the terminal connector in which the facing surfaces 20, 21 of the first and second arm portions 14, 16 are each provided with upsets or dimples 42 for limiting relaxation of the flat conductor cable 30 in a radial direction away from the upstanding post 18. The dimples 42 are arranged on the facing surfaces 20, 21 of the first and second arm portions 14, 16 adjacent the post 18 and die opening 22 at the same radial distance from the center line of the post 18 and the opening 22. These dimples 42 serve to retain the flat conductor cable 30 so that it remains in intimate contact with the post 18 after installation on the flat conductor cable 30 thereby ensuring good electrical contact between the conductor of the cable 30 and the post 18. Sufficient pressure is exerted on the conductor cable 30 by sandwiching the conductor cable 30 between the dimples 42 on the surface 20 of the first arm portion 14 and the corresponding mating dimples 42 on the surface 21 of the second arm portion 16.

Still further embodiments for the terminal connector are shown in FIGS. 6*a*–6*d* which illustrate different means for holding the first and second arm portions 14, 16 in the installed closed position on flat conductor cable 30. For example, in the embodiments shown in FIG. 6*a* and 6*b* (which are exploded side sectional views of portions of the first and second arms 14, 16), a portion of the cylindrical outer surface of the post 18 is designed to be upset or deformed with a suitable tool into a recessed area 44 of the die opening 22 in the the second arm portion 16 after completion of the installation of the connector onto the flat conductor cable 30. The recessed area 44 for receiving this upsetting may take a variety of forms such as for example the bevelled recess area 44 shown in FIG. *6a* or the cylindrical recessed area 44' shown in FIG. *6b*. Further variations in the nature of "riveting" for holding the first and second arm portions 14, 16 together in the closed connected position are shown in perspective in FIGS. *6c* and *6d*. FIG. *6c* shows the use of slots 46 through the side cylindrical surfaces of the upstanding post **18*b*** to facilitate the deformation, whereas FIG. *6d* shows the use of triangular shaped straight sections 48 which are adapted to bend radially outward relative to the central opening 38 of the post **18*c***. These latter two constructions will facilitate the upsetting of the end of the post onto the outside surface of the second arm portion after the first and second arm portions have been moved into the closed connecting position. The upsetting or bending may be accomplished with the use of any suitably designed tool.

FIGS. *7a–7e* illustrate various alternative arrangements for the upper end of the upstanding post 18 for cutting through of the flat conductor cable 30. For example, FIG. *7a* shows a cutting surface **19*d* having a multiplicity of sharp teeth 50 at the upper edge of the post 18*d***. In FIG. *7b*, the upper end of the upstanding post **18*e* is provided with a bevelled surface 52 extending downwardly towards the interior of the post 18*e* to provide a sharp cutting surface 19*e* at the outer edge of the post 18*e***. A further variation is shown in FIG. *7c* which shows the upper end of the upstanding post **18*f* bevelled at 54 in the opposite direction to provide a sharp surface 19*f* located at the inside diameter of the post 18*f***. A still further variaftion is shown in FIG. *7d* in which the upper end of the post **18*g* includes oppositely extending bevels 56, 58 to define a sharp surface 19*g* at the apex between the inner and outer surfaces of the post 18*g***. Finally, FIG. *7e* shows the upper end of the post **18*h* including a bevelled end surface which slopes downwardly towards the open portion of the connector 10 so that a sharper cutting edge 19*h* is initially presented for shearing or cutting through the flat conductor cable 30** during installation.

It should be realized that with any of the arrangements shown in FIGS. *7a–7e* or with the arrangement shown in FIGS. 1 and 2, the cutting edge 19 for cutting through the flat conductor cable 30 on the upstanding post 18 is inclined at an angle with respect to the plane of the second arm portion 16 so that only a portion of the cutting surface or edge 19 initially contacts the flat conductor cable 30 as the post 18 begins to enter the die opening.

FIGS. *8a–8e* illustrate additional configurations for the cutouts 24 placed along the desired bending line 12 to provide for precision alignment of the first and second arm portions 14, 16 during installation. For example, FIG. *8a* shows V-shaped cutouts **24*a*** whereas FIG. *8b* shows oval shaped cutouts **24*b*** and FIG. *8c* shows key shaped cutouts **24*c*. With each of these configurations, as well as with the semi-circular cutouts 24 shown in FIG. 1, a reduced cross-sectional area is provided along the bending line 12 of the connector to faciliate bending by reducing the bending force required along the bending line 12** to ensure that the complete bend will take place at the desired location.

Figure 9:
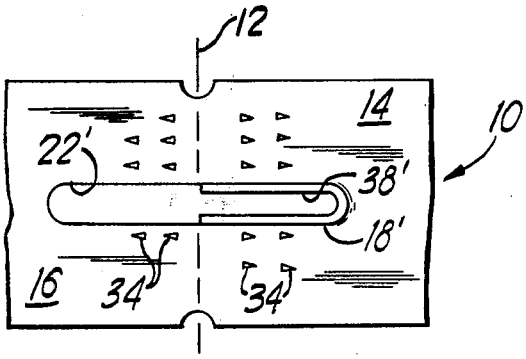
FIG. 9 shows a flat layout of an alternative arrangement for the connector member of the present invention in which an elongated slot for a mechanical fastener is provided.
Figure 10:
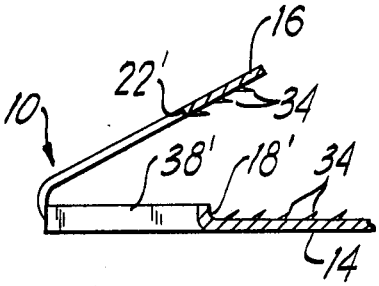
FIG. 10 shows a side sectional view of the connector of FIG. 9 in which the first and second arm portions have been bent along the bending line to a position for receiving flat cable.

FIGS. 9 and 10 illustrate an alternative arrangement for the connector 10 in accordance with the present invention in which an elongated slot 38' is provided in place of a round hole for receiving an appropriately shaped mechanical fastener. More particularly, as best seen in FIG. 9, the connector 10 includes a bending line 12 separating the connector into first and second arm portions 14, 16. The second arm portion 16 includes an elongated slot or opening 22' extending therethrough which extends longitudinally away from the bending line 12 whereas the first arm portion 14 includes an upstanding male die member 18' of a configuration to fit within the slot 22' provided in the second arm portion 16 and arranged to be received within such slot 22' when the connector 10 is bent along the bending line 12. The male die member 18' includes an elongated opening 38' therethrough for receiving a suitably shaped mechanical fastener after the connector 10 is assembled or installed onto the flat conductor cable. As best seen in FIG. 9, the male die member 18' and the slot 38' therein begin adjacent the bending line 12 and extend perpendicularly outward with respect to the bending line 12.

As with the embodiment shown in FIGS. 1 and 2, a flat cable is inserted between the first and second arm portions 14, 16 and the connector 10 is bent to move the first and second arm portions 14, 16 towards one another to shear a hole in the flat conductor cable. With this arrangement it may be preferable to provide insulation piercing teeth 34 on the inner surfaces of the first and second arm portions 14, 16 to help retain the connector 10 installed on the cable when the first and second arm portions 14, 16 are in the closed connecting position. The slot 22' in the second arm portion 16 and the upstanding male die member 18' on the first arm portion could be located a short distance from the bending line 12 of the connector, so that a portion of the flat cable will be between the male die member 18' and the bending line 12 to help retain the connector 10 in place on the cable.

Thus, it is seen that in accordance with the present invention, there is provided a terminal connector 10 suitable for use in making a terminal connection in a flat conductor cable 30. In a preferred embodiment in accordance with the present invention, the connector 10 serves to remove a portion 32 of the flat conductor cable 30 during installation so as to provide a place for acceptance of a suitable mechanical fastener 36 for attaching the connector 10, and thus the flat connector cable 30, to a suitable device 40. This is accomplished in accordance with the present invention by providing a geometric relationship between an upstanding post 18 on the first arm portion 14 and a die opening 22 in the second arm portion 16 whereby a moving shear surface concept is obtained starting with a small initial contact area and progressing along the surface of the cable 30 as the first and second arm portions 14, 16 are moved together to a closed connecting position. Further still, with use of the connector 10 of the present invention, means 18, 26 are provided for transferring forces concentrated on the connector 10 when the mechanical fastener 36 is applied thereto so as to prevent or limit distortion of the connector surfaces when the fastener 36 is installed which might otherwise change penetration and/or contact pressures ensuring good electrical conductivity. Further, in accordance with the present invention, the upstanding post 18 and die opening 22 are provided in fixed relationship with respect to the bending line 12 on the bendable connector member, which bending line 12, in a preferred embodiment, is defined by removing material at the desired location of bending to reduce forces required to accomplish bending. Further still, in another aspect of the present invention, means may be provided for mechanically fastening or locking the first and second arm portions 14, 16 together by rolling or riveting of a protruding portion of the upstanding post 18 which extends through the second arm portion 16. Finally, in accordance with another embodiment, means 42 may be provided for confining and holding the flat conductor cable 30 between the first and second arm portions 14, 16 to eliminate movement of the cable 30 by outside forces. Such means for holding the cable 30 may comprise dimples or opposed upsets 42 located on the surfaces of the first and second arm portions 14, 16 facing one another to thus sandwich the cable 30 therebetween to ensure high conductivity between the current carrying members of the flat conductor cable 30 and the connector 10.

Stated in a different manner, the connector 10 has projecting from surface 20, at a second location distal from bending axis 12, a die means 18 having thereabout an endless die surface 19 at its end 26 arranged to engage the endless shearing surface about the opening 22 in arm 16. The opening 22, located at a first location distal from bending axis 12 and extending from a first surface 21 to a spaced apart parallel second surface, is registrable with said die means 18 when the connector 10 is bent about bending axis 12.

The rotary nature of the bending of the connector 10 about bending axis 12 presents the endless shearing surface and endless die surface 19 to one another in a progressive manner to progressively make a predetermined cut in a flat connector cable placed between the arms 14, 16. The cut made can be complete and in the shape of a circle, square, rectangular or any other convenient shape or may be an incomplete figure, if desired. An electrical path will be established between the die means 18 and the conductor of the flat conductor cable once the insulation about the conductor has been fully or partially severed. A bore placed in said die means to receive a fastener permits a further electrical connector to be connected to the joint of the connector 10 with the conductor of the flat conductor cable.

Alternatively, the endless shearing surface may be placed on the die means 18 and the endless die surface placed about the opening 22.

While the preferred embodiments of the present invention have been shown and described, it will be understood that such are merely illustrative and that changes may be made without departing from the scope of the invention as claimed.

What is claimed is:

1. A terminal connector for a flat cable, said connector comprising:

a bendable member for bending along a bending line, said bendable member including a first arm portion and a second arm portion separated from one another by said bending line;

a male die member on said first arm portion extending away from the surface of said first arm portion and having at its distal end a peripheral edge therethrough;

said second arm portion including therethrough an opening for receiving said male die member, said opening having a periphery that is configured to interact therearound with the peripheral edge of said male die member, defining a pair of progressively operative shearing members when said bendable member is bent along said bending line to move said first and second arm portions toward one another into a closed connecting position.

2. The terminal connector of claim 1 wherein said male die member is electrically conducting for making electrical contact with a flat conductor cable positioned between said male die member and said die opening when said bendable member is bent along said bending line to move said first and second arm portions toward one another.

3. The terminal connector of claim 1 wherein said male die member includes cutting means for cutting out a portion of a flat cable positioned between said die member and said die opening when said bendable member is bent along said bending line to move said first and second arm portions toward one another, said cutting means being located at the end of said male die member away from the surface of said first arm portion.

4. The terminal connector of claim 3 wherein said cutting means comprises a cutting edge defined by said peripheral edge of said die member at said end away from the surface of said first arm portion, said cutting edge cooperating with the periphery of said die opening in said second arm portion when said bendable member is bent along said bending arm to cut the flat cable inserted between said first and second arm portions.

5. The terminal connector of claim 4 wherein said die member extends away from said first arm portion at an angle such that said second arm portion is inclined with respect to said cutting edge of said die member when said die member begins to enter said die opening as said bendable member is bent along said bending line to thereby concentrate the cutting force exerted on the flat cable by said cutting edge to cut an opening in the flat cable whereby only a portion of said cutting edge enters said die opening initially and the remaining portions of said cutting edge progressively enter said die opening as said first and second arm portions are moved towards one another.

6. The terminal connector of claim 3 wherein said cutting means on said die member defines a cutting plane arranged at an angle with respect to said die opening when the end of said die member begins to enter said die opening.

7. The terminal connector of claim 1 wherein said male die member on said first arm portion includes an opening extending therethrough for receiving a fastener.

8. The terminal connector of claim 7 wherein said opening in said male die member comprises a bore having a threaded portion for receiving a threaded fastener.

9. The terminal connector of claim 1 wherein said first and second arm portions each have a first surface and a second opposite surface, said first surfaces of said first and second arm potions opposing one another when said first and second arm portions are in said closed connecting position and when said male die member extends away from said first surface of said first arm portion.

10. The terminal connector of claim 9 wherein the end of said male die member extends through said die opening at least to said second surface of said second arm portion when said bendable member is in the closed connecting position.

11. The terminal connector of claim 10 wherein said second arm portion is substantially parallel to said first arm portion when said bendable member is in said closed connecting position.

12. The terminal connector of claim 9 further including insulation piercing members on said first surfaces of said first and second arm portion for making electrical contact with the conductor of a flat conductor cable inserted between said first and second arm portions when said bendable member is in said closed connecting position.

13. The terminal connector of claim 9 further including a plurality of clamping members on said first surfaces of said first and second arm portions for engaging the opposite surfaces of a flat cable when said bendable member is in said closed connecting position.

14. The terminal connector of claim 13 wherein said clamping members on said first arm portion are arranged to lie directly opposite from said clamping members on said second arm portion when said bendable member is in said closed connecting position.

15. The terminal connector of claim 9 further including holding means for holding said first and second arm portions in said closed connecting position.

16. The terminal connector of claim 15 wherein said holding means comprise a deformable end of said male die member which is adapted to be deformed after being received in said die opening of said second arm portion to hold said first and second arm portions together.

17. The terminal connector of claim 16 wherein said second arm portion includes an enlarged recess adjacent said die opening into which said deformable end of said male die member is adapted to be deformed.

18. The terminal connector of claim 16 wherein said male die member extends beyond said second surface of said second arm portion when said bendable member is in said closed connecting position and wherein said male die member includes slots for facilitating deforming of the deformable end of said male die member onto said second surface of said second arm portion.

19. The terminal connector of claim 16 wherein said deformable end of said male die member comprises triangular shaped projections.

20. The terminal connector of claim 3 wherein said cutting means on said male die member comprises a plurality of circumferentially arranged teeth at the end of said male die member extending away from said first arm portion.

21. The terminal connector of claim 3 wherein said cutting means comprises a sharp edge surface at the outside end edge of said male die member.

22. The terminal connector of claim 3 wherein said male die member extends away from said first arm portion in a direction normal to the plane of said first arm portion and wherein said cutting means defines a plane at said end surface of said male die member which is inclined with respect to said direction normal to said first arm portion.

23. The terminal connector of claim 1 wherein said bendable member includes cutouts along said bending line to facilitate bending therealong.

24. The terminal connector of claim 23 wherein said cutouts are semi-circular.

25. The terminal connector of claim 23 wherein said cutouts are V-shaped.

26. The terminal connector of claim 23 wherein said cutouts are oval shaped.

27. The terminal connector of claim 23 wherein said cutouts are key shaped.

28. The terminal connector of claim 1 wherein said male die member comprises an elongated member extending in a direction normal to said bending line and wherein said die opening in said second arm portion is of a size and shape to receive said elongated member.

29. A terminal connector for connection with flat conductor cable of type having enclosing electrical insulation thereabout, comprising: a plate member having first and second surfaces and bendable about a bending axis therein, said plate member defining an opening therethrough extending between said first and second plate member surfaces at a first location distal from said bending axis, said plate member defining an endless shearing surface about said opening; and die means, having an endless die surface thereabout of configuration for interacting with said endless shearing surface therearound, carried by said plate member at a second location distal from said bending axis and registrable with said first location upon the bending of said plate member, the bending of said plate member about the bending axis presenting said endless die surface progressively at an acute angle to said endless shearing surface to progressively shear a flat conductor cable placed within said terminal connector and thereby cut out a portion thereof.

30. A terminal connector for connection with flat conductor cable of type having enclosing electrical insulation thereabout, comprising: a plate member having first and second surfaces and bendable about a bending axis therein, said plate member defining an opening therethrough extending between said first and second plate member surfaces at a first location distal from said bending axis, said plate member defining an endless die surface about said opening; and die means, having an endless shearing surface thereabout of configuration for interacting with said endless die surface therearound, carried by said plate member at a second location distal from said bending axis and registrable with said first location upon the bending of said plate member about the bending axis presenting said endless shearing surface progressively at an acute angle to said endless die surface to progressively shear a flat conductor cable placed within said terminal connector and thereby cut out a portion thereof.

31. In combination, a flat conductor cable having a conductor, and an electrical terminal connector for said flat cable, said terminal connector comprising a bendable member having first and second arm portions arranged to overlie one another on opposite sides of said flat conductor cable, said first arm portion including an electrically conducting male die member extending away from said first arm portion towards said second arm portion and having at its distal end a peripheral cutting edge therearound, and said second arm portion including therethrough a die opening in which said male die member is received, said opening having a periphery interacting theraround with said cutting edge, a portion of said flat cable and conductor being cut out by said interacting cutting edge and periphery, said flat cable being connected to said connector with said male die member extending into said cut out portion and being in electrical contact with said conductor of said flat cable.

32. The combination of claim 31 wherein the end of said male die member away from said first arm portion extends through said die opening.

33. Th combination of claim 32 further including a termination device for connection with said flat conductor cable, and wherein said male die member includes an opening therethrough for receiving fastener means for connecting said terminal connector to said termination device.

34. The combination of claim 33 wherein the end of said male die member away from said first arm portion provides a bearing surface for said fastener means.

35. The combination of claim 34 wherein the end of said male die member extends completely through said die opening in said second arm portion to provide said bearing surface for said fastening means.

36. The combination of claim 34 further including insulation piercing teeth on the opposing surfaces of said first and second arm portions.

37. The combination of claim 34 wherein said fastener means is externally threaded and wherein said male die member is internally threaded to receive said externally threaded fastener means.

38. In combination, a flat conductor cable having at least one electrical conductor therein and having electrical insulation thereabout, and an electrical terminal connector for making electrical and mechanical contact with said flat conductor cable, said terminal connector comprising: a plate member having first and second surfaces and bendable about a bending axis therein, said plate member defining an opening therethrough extending between said first and second plate member surfaces at a first location distal from said bending axis, said plate member defining an endless shearing surface about said opening; and die means, having an endless die surface thereabout of configuration to enter matchingly said opening, carried by said plate member at a second location distal from said bending axis and registerable with said first location upon the bending of said plate member, the bending of said plate member about the bending axis presenting said endless die surface progressively to said endless shearing surface to progressively make an aperture through a flat conductor cable placed within said terminal connector to permit said die means to enter such aperture and make electrical contact with the electrical conductor in said flat conductor cable, creating an electrical path between such conductor and said electrical terminal.

39. The combination defined in claim 38 further comprising a bore through said die means to receive a fastening means to permit a further electrical conductor to be joined to the joint of said electrical conductor and electrical terminal.

40. The terminal connector of claim 1, wherein said die member and said opening are substantially circular.

* * * * *

UNITED STATES PATENT AND TRADEMARK OFFICE

CERTIFICATE OF CORRECTION

PATENT NO. : 4,256,359

DATED : March 17, 1981

INVENTOR(S) : Glenn E. Storck

It is certified that error appears in the above-identified patent and that said Letters Patent are hereby corrected as shown below:

Column 9, line 65 (Claim 1, line 10), "through" should be -- around --.

Signed and Sealed this

*Twenty-sixth* Day of *January 1982*

[SEAL]

*Attest:*

GERALD J. MOSSINGHOFF

*Attesting Officer*

*Commissioner of Patents and Trademarks*